US005082249A

United States Patent [19]

Havlovitz

[11] Patent Number: 5,082,249

[45] Date of Patent: Jan. 21, 1992

[54] SAFETY LOCKING DEVICE FOR COLLAPSIBLE BARRICADE FOR STREETS AND HIGHWAYS

[75] Inventor: Paul M. Havlovitz, Escondido, Calif.

[73] Assignee: Republic Tool & Manufacturing Corp., Carlsbad, Calif.

[21] Appl. No.: 406,501

[22] Filed: Sep. 13, 1989

[51] Int. Cl.[5] ..... E04H 17/00; F16M 11/00

[52] U.S. Cl. ..... 256/64; 182/153; 182/225; E04H/17/00; F16M/11/00

[58] Field of Search ..... 256/64; 182/153, 159, 182/181, 225, 224, 155, 182-186; 404/6

[56] References Cited

U.S. PATENT DOCUMENTS

| | | | |
|---|---|---|---|
| 1,224,893 | 5/1917 | Beckwith . | |
| 2,651,487 | 9/1953 | Loock et al. | 182/181 X |
| 2,995,847 | 8/1961 | Carpenter . | |
| 3,086,740 | 4/1963 | Hatton . | |
| 3,527,434 | 9/1970 | Mauro . | |
| 4,183,695 | 1/1980 | Wilcox | 404/6 |
| 4,238,001 | 12/1980 | Alexander | 182/153 |
| 4,375,245 | 3/1983 | Schill | 182/155 |
| 4,605,099 | 8/1986 | Crum et al. | 182/225 X |
| 4,645,162 | 2/1987 | Roy et al. | 182/155 X |
| 4,681,187 | 7/1987 | Brown . | |
| 4,696,470 | 9/1987 | Fenner | 182/153 X |
| 4,778,250 | 10/1988 | McRoskey et al. | 256/64 X |
| 4,875,797 | 10/1989 | Hartwig | 404/6 X |
| 4,880,080 | 11/1989 | Brockman | 182/155 |

*Primary Examiner*—Peter M. Cuomo

*Attorney, Agent, or Firm*—Harry Williams

[57] ABSTRACT

A rotatable locking device composed of a flexible plastic material is disposed adjacent the end portions of each pair of legs for barricade structure for streets and highways. The locking device can be rotated into an operating position where it bears against the tips of the end portions of the legs when extended and so locks them into place to thereby keep the legs extended during harsh weather conditions and when the barricade is subjected to repeated gusts of winds from passing trucks. When the barricade is suddenly impacted, however, the end portions of the leg members will spring free from the locking devices owing to elastic deformation or "forgiveness" of the flexible plastic material that comprises both locks and legs to thereby allow the leg members of the barricade to fold or collapse to a safe position.

3 Claims, 1 Drawing Sheet

FIG. 1
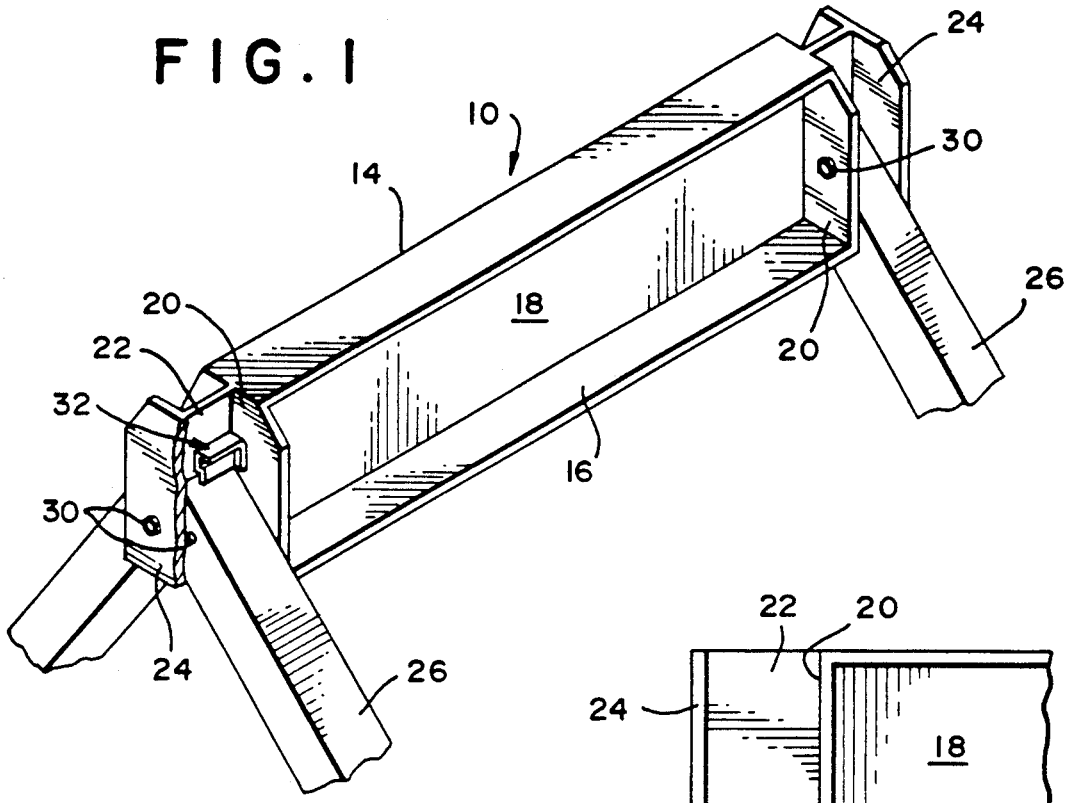
FIG. 2
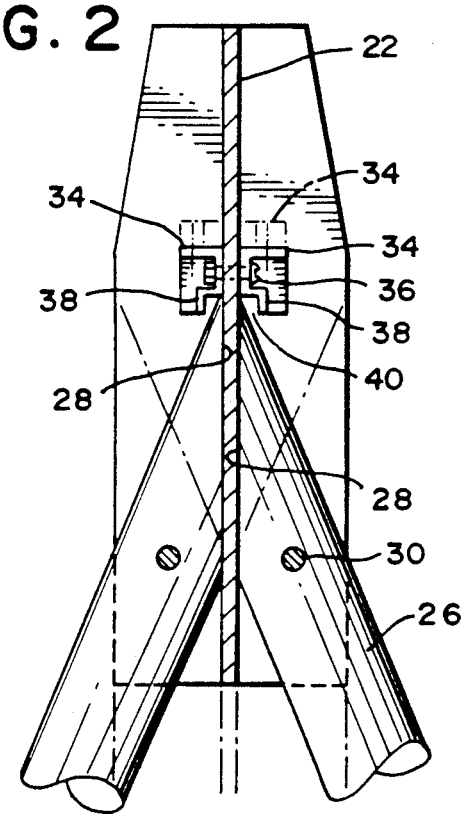
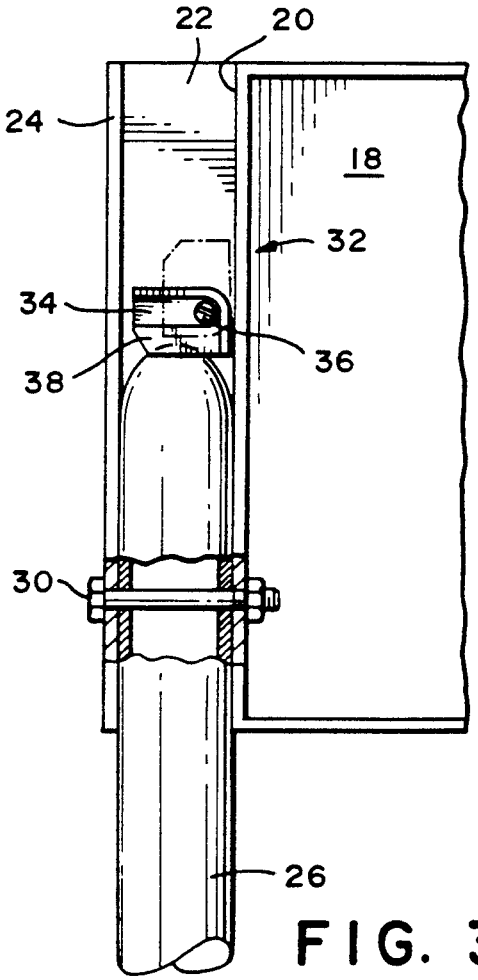
FIG. 3

SAFETY LOCKING DEVICE FOR COLLAPSIBLE BARRICADE FOR STREETS AND HIGHWAYS

BACKGROUND OF THE INVENTION

This invention is related to a locking device for barricade structures for streets and highways, such as those barricades which comply with the requirements of the Manual on Uniform Traffic Control Devices for Streets and Highways issued by the U.S. Department of Transportation, Federal Highway Administration, and described more specifically in U.S. Pat. No. 4,778,250, assigned to the same assignee as the present invention.

The barricade described in the above-mentioned patent and barricades of generally similar design have for their main purpose to provide a warning on a street or highway while at the same time providing , reflective efficiency, durability and safety in the work area in case the barricade is struck by a fast moving vehicle. Often such barricades are positioned in a critical location for an extended period of time; and if the barricade is not weighted down with sand bags which by virtue of their weight and bulk can prove hazardous themselves, the barricade's stability can be compromised by the accumulating effects of the wind, particularly gusts from passing trucks, acting on the extended leg supports, so that the legs become gradually and incrementally shifted towards each other until ultimately the barricade falls over. Naturally, some kind of locking device on the barricade can be implemented to keep the legs apart. But this method only serves to maintain the legs in a permanently extended position; in case of impact the barricade does not collapse and therefore poses a grave danger if in its fully extended position it suddenly becomes airborne.

OBJECTS AND SUMMARY OF THE INVENTION

It is a primary purpose and principle object of the present invention to provide a safety-barricade structure which overcomes the aforementioned problems characteristically associated with barricade structures of the aforementioned kind. More particularly, the present invention sets forth a durable, highly stable, collapsible, safety-barricade structure in compliance with the requirements of DOT. The barricade structure is also lightweight, portable, retro-reflective, and economic to manufacture; and by virtue of its construction it significantly reduces hazard to both automobile and personnel in case of impact at high speed.

Specifically, the present invention provides a safety-barricade structure which is durable, lightweight and portable and which meets the requirement for both Type I and Type II barricades, according to the *Manual on Uniform Traffic Control Devices*. In accomplishing these objectives, the subject invention proposes a reinforced, all-plastic construction in which opposing end portions of pivotal leg members are disposed directly against opposing faces of a single support wall at each end of the vertical panel. A rotatable locking device is associated with the end portions of each pair of legs for the barricade structure, so that the locking device can be rotated into an operating position where it bears against the tips of the end portions of the legs when extended and so locks them into place. The locking device as well as the legs are constructed from a flexible plastic material so that when the barricade is suddenly impacted upon by a moving vehicle, for example, the end portions of the legs will suddenly pivot and spring out of engagement from the locking devices to thereby allow the leg members of the barricade to fold or collapse to a relatively safe position. This "forgiveness" of the plastic in both legs and locks also allows the locking devices to be reusable, since there will be no broken parts as a result of impact.

The invention will be better understood as well as further objects and advantages thereof become more apparent from the ensuing detailed description taken in conjunction with the drawings.

BRIEF DESCRIPTION OF THE DRAWINGS

FIG. 1 is a schematic perspective view of the safety-barricade with the locking device according to the invention;

FIG. 2 is an enlarged schematic end view of the safety-barricade shown in FIG. 1; and FIG. 3 is a schematic side elevation of the safety-barricade shown in FIG. 2.

DETAILED DESCRIPTION

Referring now to FIG. 1, the safety barricade with the locking device feature according to the invention is composed of a vertical panel 10 bearing reflective markings 12 on opposite faces thereof, such as an 8 inch to 12 inch wide surface with 4 inch wide stripes at 45 degrees with respect to the long axis of the panel. It will be understood, therefore, that the barricade according to the invention will reflect in opposite directions by means of a single vertical panel. The panel 10 consists generally of an I-beam configuration having top and bottom parallel walls 14 and 16, a median vertical wall 18 and opposing end walls 20. Since the wall construction at one end of the panel is a mirror image of the other, the same reference numbers will be used for identical parts. Extending coplanar with the median wall 18 from opposite faces of the end walls 20 is a leg supporting wall 22. Disposed at right angles at the end of the leg support walls 22 is an end plate 24 corresponding in size and shape to the end walls 20. All of the elements above-mentioned are suitably formed of molded plastic into a single unitary structure.

Between the end wall 20 and the corresponding end plate 24, there is thus provided a U-shaped channel on each side of the leg supporting wall 22 into which fits the upper portion of a leg member 26. The leg members can be of a rectangular cross-section or circular in cross-section and are also formed of molded plastic. The upper portion of the leg members 26 are angled to present an oblique bearing face 28 which rests flush against the leg supporting wall 22. To pivotally secure the leg members 26 in their appropriate channel spaces, suitable bolts 30 extend through aligned holes provided in end plate 24, leg member 26, and end wall 20, as shown in FIG. 3. The leg members 26 are extended, as shown. so that the angled bearing faces 28 are flush against opposing faces of the leg supporting wall 22. The vertical panel is thus firmly held and locked into place at each end thereof by means of the clamping effect of the opposed bearing faces 28 against the wall 22. Thus the vertical panel 10 is secured rigidly on orthogonally related axes for optimum stability when the legs 26 are in their extended position.

Pivoted to the wall 22 in each end housing structure is the locking device 32, according to the invention. As shown in greater detail in FIGS. 2 and 3, the locking device is made up of two complimentary plastic blocks 34, each of which is generally rectangular in shape and which are pivotally connected by means of a bolt 36 extending through an aperture in the wall 22. Each block 34 is provided with a flange portion 38 that is spaced from the wall surface 22, thereby creating a space or cavity 40 in which extends the tip of the end portion of a leg member 26 when the leg members are extended and the block 34 is rotated to the position shown.

When the barricade is so arranged with its legs extended and locked into place, it can be collapsed only if impacted by a great force, which is a desirable end in itself insofar as a collapsed barricade is far less hazardous than a fully extended one after impact with a vehicle or other large object. This new and useful result is achieved by means of using a flexible plastic material for both the legs and the locking devices as above described, so that both the tips of the legs and the locking devices will "forgive" each other upon sudden impact, that is, be elastically deformed and thereby spring free from each other, thus allowing the legs of the barricade to fold to an inoperative safe position. Because the locking devices according to the invention are not broken after impact upon the barricade, the same locking devices can be used again.

When the blocks 34 of the locking devices 32 are rotated to an inoperative position, as shown in phantom in FIG. 3, then the leg members 26 may be rotated about their respective pivots to a closed storage position, that is, a folded position for the barricade structure 10, as shown in phantom in FIG. 2. It will be seen that the leg members 26 when so positioned in the closed storage position are completely within the confines of the end housing structure of the barricade made up by walls 20, 22, and 24, again as shown in phantom in FIG. 2.

It should be understood that the safety locking device according to the present invention need not be limited to the type of barricade structure described above but may be incorporated into other barricade structures that also use pivotal leg arrangements but which may not be defined by the use of vertical panels to support reflective or sign-bearing graphics. For example, such panels may be angled with respect to the road surface because they are supported on the leg support members themselves.

The foregoing relates to preferred exemplary embodiment of the present invention, it being understood that other embodiments and variants thereof are possible within the scope of the invention, the latter being defined by the appended claims.

What is claimed and desired to be secured by Letters Patent of the United States is:

1. A barricade structure for use in a highway or street, comprising a panel member, said panel member having a wall support means, leg member means for supporting respective end portions of said leg member means on said wall support means, a locking means disposed on said wall support means and having means defining a cavity therein, said locking means having a first locking position for allowing said respective end portions of said leg member to extend into said cavity means and a second release position for freeing said respective end portions of said leg member means, means pivotally supporting said locking means for movement within a plane perpendicular to a plane of movement of said leg members, and said locking means being formed from a flexible plastic material and thereby being subject to elastic deformation in said first locking position upon impact with said end portions of said leg member means when said leg member means are forcefully pivoted about said leg member pivotal means, whereby said end portions of said leg member means pans through said cavity means to engage and snap past said locking means to thereby free said end portions of said leg member means from said first locking position without said locking means being moved to said second release position.

2. A barricade structure having a light reflective means for use in a highway or street, comprising a panel member bearing said light reflective means, said panel member having a pair of oppositely disposed housing structures, each of said housing structures having a wall support means, leg member means for supporting said panel member, means for pivotally supporting respective end portions of said leg member means in each of said housing structures, whereby a bearing face of each said respective end portions of said leg member means bears against said wall support means when said leg member means are in a first extended position, said bearing face being free of contact with said wall support means when said leg member means are in a second closed storage position, a locking means disposed on said wall support means and having means defining a cavity therein, means pivotally supporting said locking means for movement within a plane perpendicular to a plane of movement of said leg members, said locking means being rotated to a first locking position for allowing said respective end portions of said leg member means to extend into said cavity means when in said first extended position and to a second release position for allowing said respective end portions of said leg member means to be moved to said second closed storage position, and said locking means being formed from a flexible plastic material and thereby being subject to elastic deformation in said first locking position upon impact with said end portions of said leg member means when said leg member means are forcefully pivoted about said leg member pivotal means, whereby said end portions of said leg member means pass through said cavity means to engage and snap past said locking means to thereby free said end portions of said leg member means from said first locking position without said locking means being moved to said second release position.

3. A barricade structure having a light reflective means for use in a highway or street, comprising a panel member bearing said light reflective means, said panel member having a pair of oppositely disposed housing structures, each of said housing structures having a wall support means, leg member means for supporting said panel member, means for pivotally supporting respective end portions of said leg member means in each of said housing structures, whereby a bearing face of each said respective end portions of said leg member means bears against said wall support means, a locking means disposed on said wall support means and having means defining a cavity therein, means pivotally supporting said locking means for movement within a plane perpendicular to a plane of movement of said leg members, said locking means having a first locking position for allowing said respective end portions of said leg member means to extend into said cavity means and a second release position for freeing said respective end portions of said leg member means, and said locking means being formed from a flexible plastic material and thereby being subject to elastic deformation in said first locking position upon impact with said end portions of said leg member means when said leg member means are forcefully pivoted about said leg member pivotal means, whereby said end portions of said leg member means pass through said cavity means to engage and snap past said locking means to thereby free said end portions of said leg member means from said first locking position without said locking means being moved to said second release position.

* * * * *